US006827675B1

(12) United States Patent
Graham

(10) Patent No.: US 6,827,675 B1
(45) Date of Patent: Dec. 7, 2004

(54) METHOD AND APPARATUS FOR A REBOUND SYSTEM AND ADJUSTABLE RESISTANCE SYSTEM

(76) Inventor: Gary Graham, P.O. Box 5146, Glacier, WA (US) 98244

( * ) Notice: Subject to any disclaimer, the term of this patent is extended or adjusted under 35 U.S.C. 154(b) by 338 days.

(21) Appl. No.: 10/140,232

(22) Filed: May 6, 2002

Related U.S. Application Data

(63) Continuation of application No. 09/489,303, filed on Jan. 21, 2000, now Pat. No. 6,383,122

(60) Provisional application No. 60/137,034, filed on Jun. 1, 1999, and provisional application No. 60/116,937, filed on Jan. 23, 1999.

(51) Int. Cl.[7] ..... A63B 22/00

(52) U.S. Cl. ..... 482/122; 482/72; 482/121

(58) Field of Search ..... 482/121, 122, 482/123, 79, 130, 95, 96, 72, 66

(56) References Cited

U.S. PATENT DOCUMENTS 4,706,953 A * 11/1987 Graham
4,884,802 A * 12/1989 Graham
5,653,667 A * 8/1997 Reyes

* cited by examiner

*Primary Examiner*—Jerome W. Donnelly
(74) *Attorney, Agent, or Firm*—Michael F. Hughes; Hughes Law Firm, PLLC

(57) ABSTRACT

The exercise apparatus comprises a frame and a carriage. A resistance system resists movement of the carriage with respect to the frame and the longitudinally headward direction. The resistance system allows the resistance to be changed at the head end portion of the frame and further does not require elastic members to travel with the carriage when they are not use. The rebound system that adjusts the range of motion of the carriage comprises two flexible members attached to the carriage and the frame and a resistance member is attached to a central portion of the flexible members and resists lateral seperation of the central portions of the flexible members.

10 Claims, 14 Drawing Sheets

METHOD AND APPARATUS FOR A REBOUND SYSTEM AND ADJUSTABLE RESISTANCE SYSTEM

CROSS REFERENCE TO RELATED APPLICATIONS

The present application is a continuation application of U.S. patent application Ser. No. 09/489,303, which was filed on Jan. 21, 2000, now U.S. Pat. No. 6,383,122, entitled "Method and Apparatus for a Rebound System and Adjustable Resistance System", which in turn claims the benefit of the filing date of U.S. Provisional Application Ser. No. 60/137,034, filed Jun. 1, 1999, and also claims the benefit of the priority date of U.S. Provisional Application Ser. No. 60/116,937, filed Jan. 23, 1999.

FIELD OF THE INVENTION

The invention relates to an exercise and therapeutic apparatus and more specifically a rebound system and an improved method of altering the resistance of the carriage that the exercise participant travels upon.

BACKGROUND

The invention relates to the art of exercise apparatuses that generally consists of a stationary frame, a moving carriage, a kickplate, a resistance system and a rebound system. The exercising orientated is positioned in a supine position on the carriage as it travels in a longitudinally oscillating or reciprocating motion by exerting a force upon a kickplate that is attached to the foot end portion of the frame or by pulling upon arm cords connected head end portion of the frame.

Prior exercise apparatuses that have been disclosed in U.S. Pat. Nos. 5,042,797 and 5,364,327 that are also applications made by the inventor, disclose resistance systems that allow adjustability from the foot end portion (the portion where the kickplate is located) of the exercise apparatus only. This required the exercising participant or therapist to adjust the elastic members near the kickplate that is located to the foot end portion of the frame.

More advanced exercising participants exert greater force upon the kickplate therefor reposition the frame in a longitudinally footward direction. Hence, the acceleration of the mass of the carriage and exercising participant in the longitudinally headward direction creates a counteracting force upon the kickplate and frame in the longitudinally footward direction. This force is great enough to overcome the frictional forces between the lower ground contact portions of the frame and the surface the exercise apparatus rests upon. To help counteract the longitudinally footward movement of the frame, oftentimes the foot end portion of the apparatus was positioned against a wall. This allowed the longitudinally footward force exerted upon the kickplate and frame to be transferred to the rigid wall.

This presents a new problem for the individual changing the resistance exerted upon the carriage. To increase the resistance additional elastic members are grasped from the foot end portion of the carriage and then attached to the foot end portion of the frame. Likewise, to decrease the resistance elastic members that are attached to the extreme foot end portion of the frame are disengaged from the frame and the head or handle portions of the elastic members are returned to the foot end portion of the carriage. Because the foot end portion of the machine was usually positioned against a wall, to add additional elastic members the exercising participant or therapist had to reach under the kickplate and grab the head portions of the elastic members from the carriage and pull in a longitudinally footward direction to a mounting bracket on the extreme foot end portion of the frame. This was an awkward movement that was difficult to execute and other times was not feasible because of the immediate location of the wall.

Another issue with the earlier designs was that the elastic members that were not in an operative position traveled with the carriage. This added extra mass to the carriage which in turn created greater forces upon the exercising participant during accelerations.

A further issue with the earlier designs was that the elastic members would develop cracks on the interior surfaces near the head or handle portions. The structure of the handle portion of the elastic members consisted of a handle member that has a barbed longitudinally extending member with a smaller diameter that is frictionally engaged within the end portion of the hollow rubber tube. When the person adjusting the elastic cord grabbed on to the handle portion of an elastic strap oftentimes they would not pull the handle portion substantially longitudinal in an aligned manner with the longitudinal axis of the elastic member. But rather, they would apply a moment perpendicular to the longitudinal axis of the elastic member. This caused a slight rotation of the head portion about an orthogonal axis to the longitudinal axis of the elastic member. The effect of this moment was that it caused the barbed insert of the head member to gouge into the interior surface of the elastic member. The effect of the gouging of the interior surface was most pronounced at the deepest inserted portion of the barbed member that was inserted into the elastic member. After many cycles of changing elastic members from an inoperative positioned to an operative position, the elastic members would break as a result from a crack that began on the interior surface near the end portion of the barbed insert of the head member.

There is further an improved rebound system over the prior art devices (namely the assembly discussed in U.S. Pat. No. 5,042,797 discussed further below). The prior art rebound systems were effective in storing energy and not allowing excessive accelerations upon the carriage when the exercising participant traveled beyond the intended longitudinal range of motion. However, the prior art rebound systems were difficult to adjust in the longitudinal range of motion of travel of the carriage, and further, they were more expensive to produce.

BACKGROUND ART

Relevant prior art is disclosed in three earlier U.S. patent applications by the present inventor. The earlier applications are U.S. Ser. Nos. 696,254, 786,540, and 001,192. The apparatus of U.S. Ser. No. 001,192 comprises a platform or carriage, termed a shuttle, being mounted on rollers which engage the tracks of a track assembly or frame. The shuttle is further interconnected to the track assembly with primary and secondary energy storage and release systems comprising elastic cords. The tension forces in the cords of both systems are adjustable to influence the at-rest location of the shuttle on the tracks and the forces applied to the shuttle by the cords as the shuttle moves with respect to the tracks.

The primary system interconnects between the shuttle and both ends of the track assembly. The secondary energy absorption and release system is in constant engagement with the track assembly and intermittent engagement with the shuttle, the shuttle engaging the secondary system when the shuttle approaches one or both the extreme of its reciprocating motion on the tracks.

The engagement between the secondary system, specifically the rebound assembly, and the track assembly is effected by engagement of projections from the rebound assembly with structural stop members attached to the track assembly. The stop members are positioned so that they are engaged by the projections as the shuttle nears the limits of its travel along the tracks. After engagement the rebound assembly stopped while the shuttle continues to move, stretching the elastic cord(s) and producing forces which decelerate, stop and re-accelerate the shuttle in the opposite direction or assist the primary system in doing so if the primary system is set to operate at that point.

A more significant piece of prior art known to the inventor is disclosed in U.S. Pat. No. 5,364,327 that is issued to him. This application discloses an exercise apparatus having a frame that comprises two longitudinally extending tracks and a kickplate. The apparatus further has a carriage which is designed to move longitudinally in a reciprocating motion on the frame. The primary energy storage and release system comprises elastic cords attached to the bottom of the shuttle and to the ends of the track assembly at various points along the cords, using ferrules on the cords engaging slots in the end structures of the track assembly. These cords may be connected, and thus constantly engaged during operation, between the shuttle and one end of the track assembly, the shuttle and the other end of the track assembly or the shuttle and both ends. The system functions to bias the shuttle and its occupant toward a position along the tracks between its ends, the forces in the cord(s) serving to decelerate, stop and re-accelerate the shuttle at each end of its travel along the tracks, aided by the secondary system when necessary.

Another relevant piece of prior art is illustrated in U.S. Serial No. 092, 462 entitled "Therapeutic Exercise Apparatus and Method". This invention shows a therapeutic exercise devises that is adapted to be positioned on a table. The device utilizes elastic members that are mounted to the carriage.

OBJECTS OF THE INVENTION

It is therefore the object of the invention to provide a head end positioned resistance adjustment system that has a more convenient access to the person adjusting the resistance of the exercise apparatus.

It is another object of the invention to remove the need of having the elastic members that are not in an operative position travel with the carriage by permanently attaching the elastic members to the frame portion and attaching the head portion of the elastic members to the carriage when additional exercise resistance is required.

It is further an object of the present invention to provide a head end positioned resistance adjustment system that utilizes a flexible strap where a downward force and an upward force upon the strap at a first and second location will reposition a corresponding elastic member to an operative position.

It is another object of the present invention to provide a resistance system that is easy to maintain and replace damaged elastic members.

It is another object of the invention to provide a rebound system that is easy to manufacture and provides an exponentially increasing force in the longitudinal direction upon the carriage with respect to longitudinal travel of the carriage at the extreme longitudinal locations of the carriage's range of motion.

It is another object of the invention to provide a rebound system that allows the carriage's range of motion to be adjusted in a convenient manner.

Further objects and advantages of the present invention will become apparent within the detailed description of the present invention.

SUMMARY OF THE INVENTION

The present invention relates to an improved resistance system that is to be implemented in an exercise apparatus which comprises a frame and a carriage. The frame has a rearward or foot end portion, a head end or forward portion, a leftward lateral side and a rightward lateral side. The carriage has a foot end portion, a head end portion, a leftward lateral side and a rightward lateral side and is adapted to travel longitudinally along the frame. An engagement section is located on the carriage. The resistance system utilizes a plurality of elastic members that extend headwardly from a base portion located in the foot end portion of the frame. The elastic members have a head portion which is on the longitudinally opposite side of the base portion and these head members are adapted to attach to the engagement section of the carriage. When the elastic members are attached to the engagement section this is referred to an operative position where tension in the longitudinally footward direction is applied to the carriage.

The present invention further has a rebound system that is to be implemented in the exercise apparatus where the rebound system comprises two flexible members. The first flexible member has a first portion, a central portion and a second portion where the first portion is mounted to the carriage and the second portion is mounted to the frame. Likewise, the second flexible member has a third portion, a central portion and a fourth portion where the third portion is mounted to a position on the carriage that is laterally right of the first portion of the first flexible member. The fourth portion is mounted to the frame laterally right of the second portion of the first flexible member. A resistance member is positioned substantially in the central portions of the first and second flexible members. The resistance member resists lateral separation of the central portions of the first and second flexible members that in turn causes tension in the first and second flexible members which exerts an exponentially increasing force upon the carriage when the carriage reaches its extremities in longitudinal travel.

DETAILED DESCRIPTION OF THE PRESENT INVENTION

Throughout this description reference is made to top and bottom, front and rear. The device of the present invention can, and will in practice, be in numerous positions and orientations. These orientation terms, such as top and bottom, are obviously used for aiding the description and are not meant to limit the invention to any specific orientation.

In the following text, there will first be a description of the prior art followed by a description of the overall components and operations the apparatus of the present invention. Finally, there will be a detailed description of a rebound system and a resistance control system.

Figure 1:
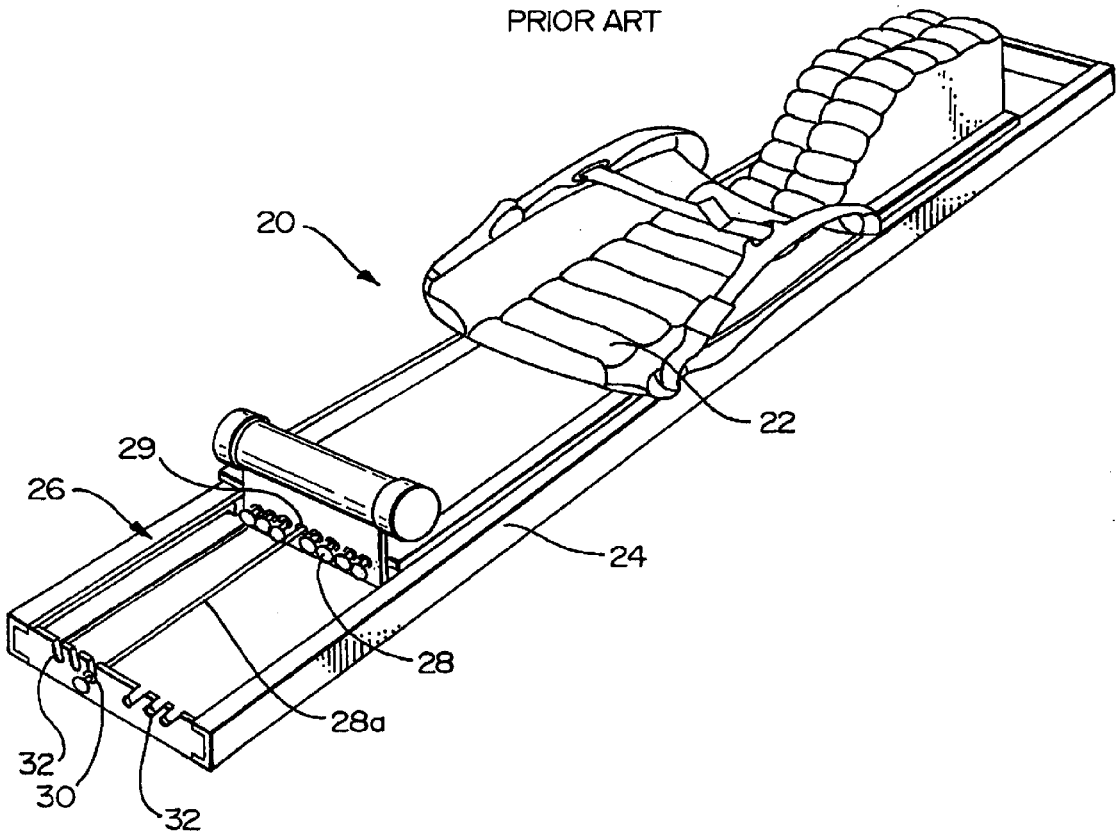
FIG. 1 PRIOR ART
FIG. 1 is an oblique view of a prior art exercise apparatus.

As seen in FIG. 1, there is a prior art device 20 that comprises a carriage 22, a frame 24 and a resistance system 26. The resistance system 26 comprises a plurality of elastic cords or members 28 which are rigidly attached to the lower head portion of the carriage 22. The other end of the elastic members 26 extend through holes 29 and hold the head portions 30 of the elastic members 28 therein when they are in the non operative position. To position the elastic members 28 in to the operative position, the head portions 30 are locked into the slots 32 which are located at the foot end portion of the frame 24. The more elastic members 28 that are positioned in the slots 32 the more resistance the user will experience when thrusting off of the kick plate (not shown). Therefore the elastic members 28 which are in the non-operative position (i.e. not locked into slots 32) travel longitudinally in oscillating manner with the carriage and the exercising participant.

Figure 2:
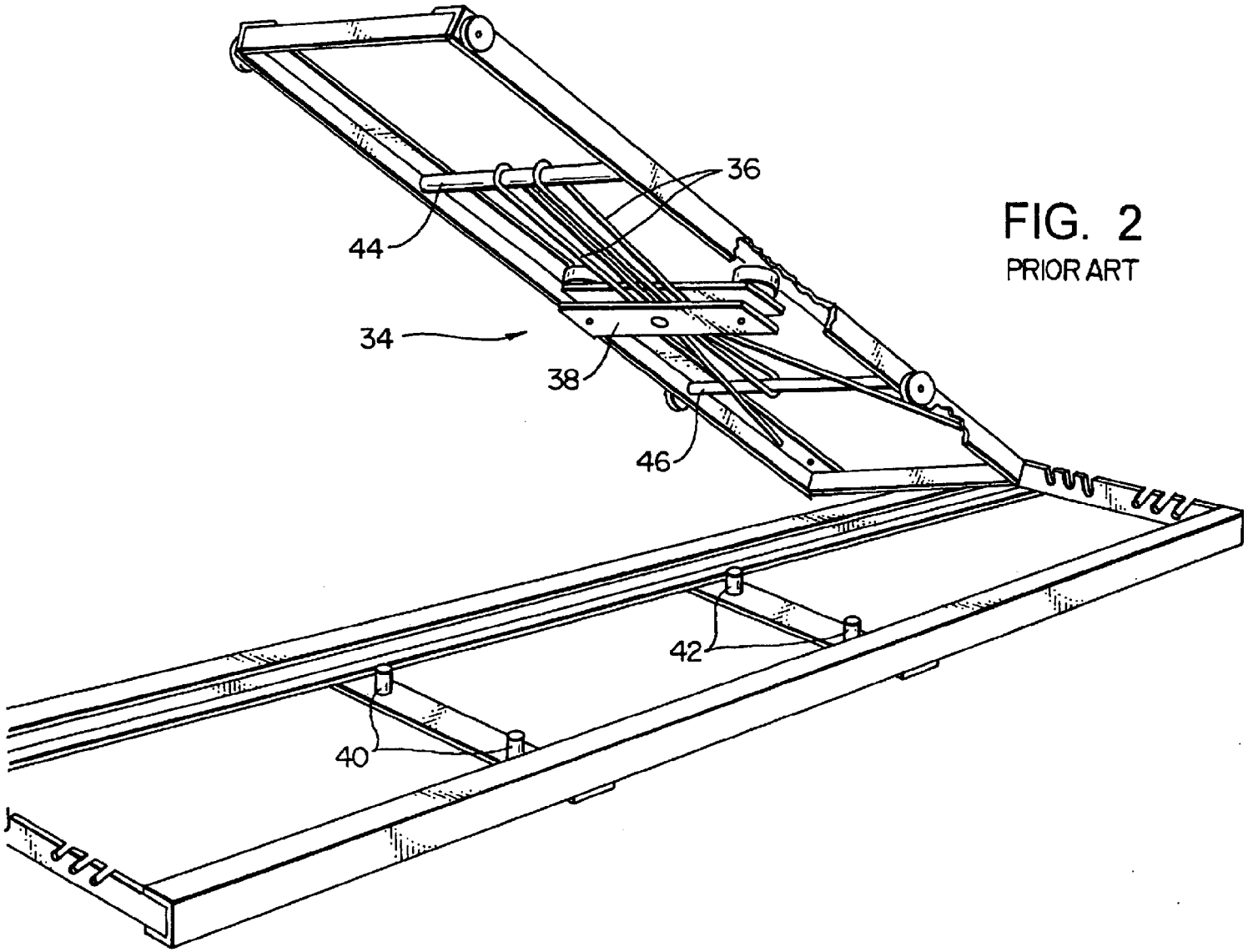
FIG. 2 PRIOR ART
FIG. 2 is an oblique view of the underside of a carriage of a prior art device.

As seen in FIG. 2, there is a view of the underside of a prior art carriage with a rebound system 34 that comprises a plurality of elastic members 36, a bounce plate 38 and stop members 40 and 42. The elastic members 36 extend around a rigid 44 and 46 and are further rigidly mounted to the bounce plate 38. The stop members 40 and 42 are rigidly mounted to the frame member and are adapted to engage the bounce plate 38.

Figures 3, 4:
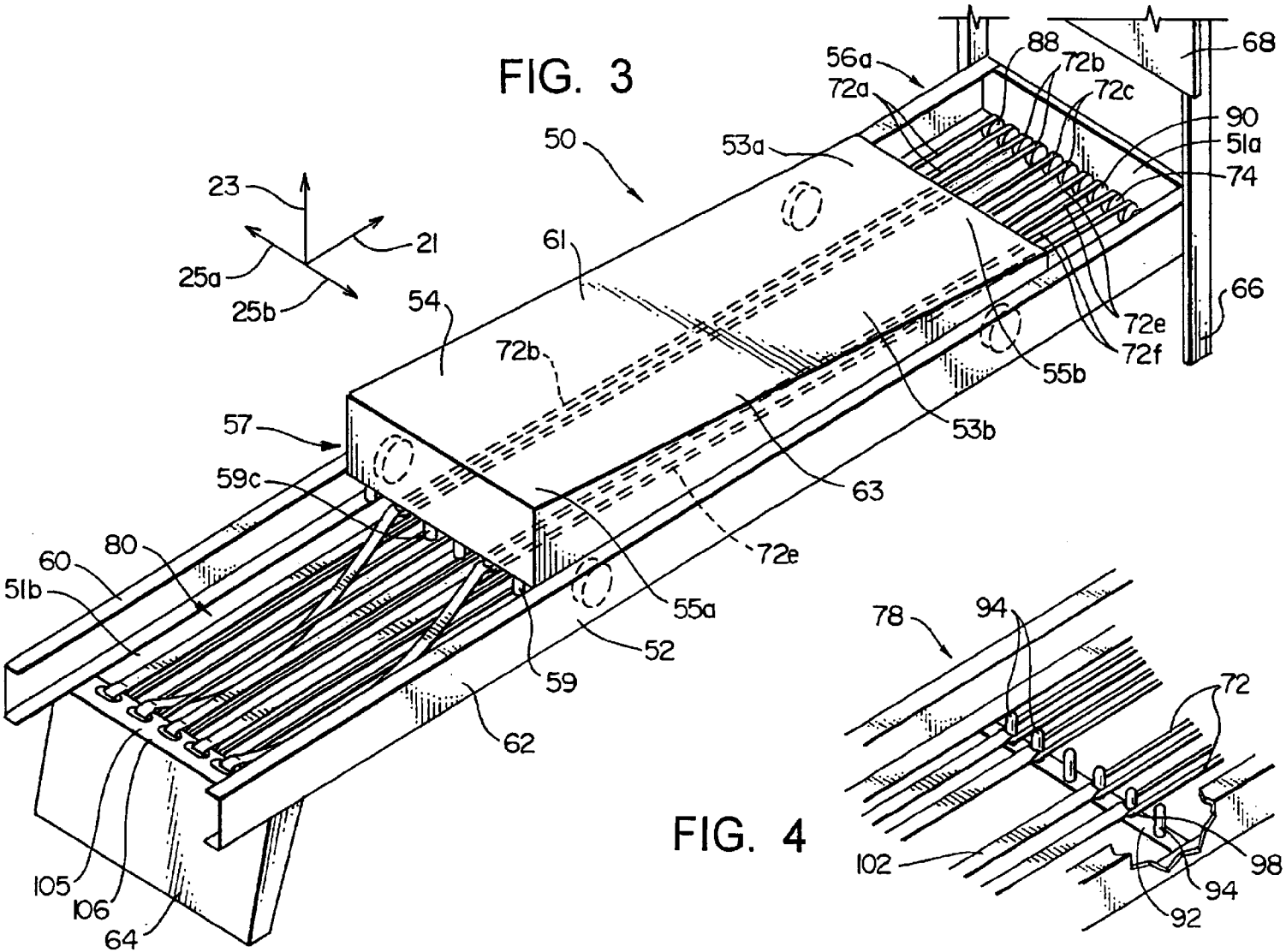
FIG. 3 is an oblique view of the apparatus of the present invention showing two elastic members in an operative position.
FIG. 4 is a view of the support system where the carriage is removed from the frame.

There will now be a description of the overall operations of the present invention followed by a detailed description of an improved rebound system and an adjustable resistance system. For purposes of explanation, a coordinate system is defined where as seen in FIG. 3, axis 21 defines a longitudinal axis and is pointed in a footward direction (and the opposite direction is defined as a headward direction). Axis 23 defines a vertical axis and is pointed in an upward direction, and finally axis 25 is defined as the lateral direction where arrow 25*a* is herein referred to as the "left" direction and arrow 25*b* indicates the "right" direction.

As seen in FIG. 3, the apparatus for the present invention 50 comprises a support structure or frame 52, a carriage 54, a resistance system 56, and a rebound system or range of motion control system 58.

In general, the support structure 52 comprises two longitudinally extending frame members 60 and 62, a first support base 64, a second support base 66 and a rigidly attached kickplate 68. The frame further has locations defined as the foot end portion 51*a*, the head end portion 51*b*, the leftward lateral portion 53*a* and the rightward lateral portion 53*b* The leftward lateral portion 53*a* is defined as any point left of the center longitudinal axis in the lateral direction. Likewise, the rightward lateral portion 53*b* is defined as any point right of the central longitudinally axis of the frame. The longitudinally extending members 60 and 62 are substantially parallel and each comprises an inner surface which houses a roller assembly that is attached to the carriage 54 so that the carriage 54 can travel in a longitudinal direction in oscillating manner with minimal undesired frictional resistance.

In the first embodiment as seen in FIG. 3, the carriage 54 has a head portion 55*a*, a foot end portion 55*b*, a leftward lateral portion 61 and a rightward lateral portion 63. The leftward lateral portion 61 is defined as any point left of the longitudinal center axis of the carriage 54. Likewise, the rightward lateral portion 63 is defined as any point right of the longitudinal center axis of the carriage 54.

Figure 5:
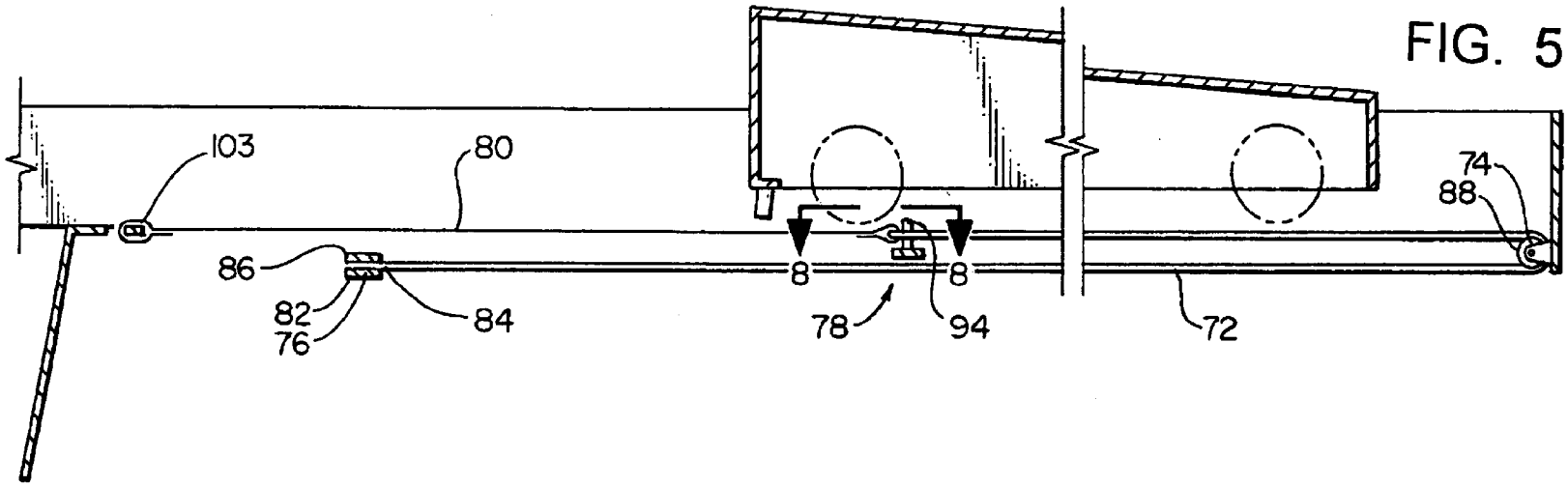
FIG. 5 is a vertical cross sectional view of the frame and carriage.

As seen in FIGS. 3, 4 and 5 the first embodiment has an engagement section 57 that is located in the head portion 55*a* of the carriage 54 and comprises a plurality of downwardly extending fingers 59.

The resistance system 56 comprises a plurality of elastic members or loops 72, a first pulley system 74, a mounting portion 76, a support system 78 and a mounting strap system 80.

Figure 6:
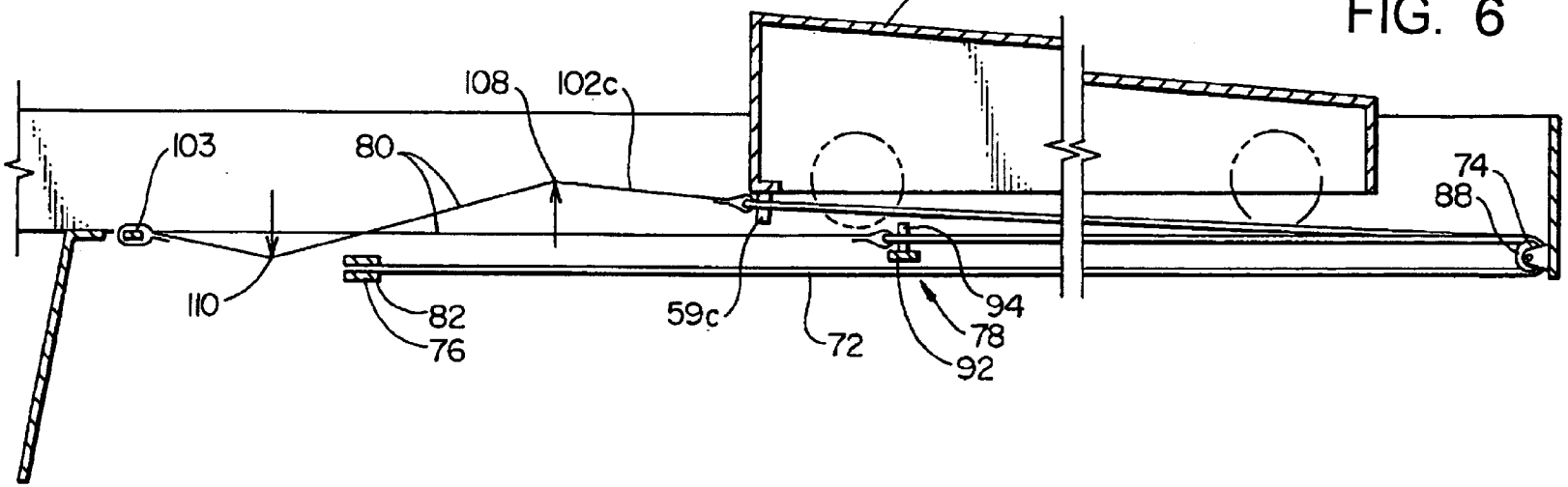
FIG. 6 is a vertical cross-sectional view illustrating how an elastic member is positioned in an operative position.

In general, the elastic members 72 are rigidly mounted to the mounting portion 76 and extend around the first pulley system or base portion 74 back to the head portion of the frame 52 to the support system 78. When it is desired to employ an elastic member 78 to an operative position, the mounting strap system 80 is employed. As seen in FIG. 6, an exercise participant or therapist can simply exert a downward force at portion 110 and an upward force at portion 108 which causes the head loop portion 98 to reposition headwardly and upwardly to attach to the fingers 59 of the carriage 54.

It should be noted that the base portion 74 is the location in the longitudinally foot end section of the frame 52. In the first embodiment the elastic members extend around the base portion 74 to the mounting portion 76 (and could extend around another pulley back to the foot end section). The important aspect of the base portion 74 is that it provides a longitudinally foot end location so there is a longitudinally footward force upon the head portions 96 of the elastic straps 72.

More specifically, the mounting portion 76 has a mounting plate 82 that is rigidly mounted to the support structure or frame 52. The end portions 84 of the elastic members 72 are positioned thereabove the mounting plate 82 and also positioned below a compression plate 86 which is bolted or otherwise attached to the mounting plate 82. A frictional material can be used to more adaquately hold the base portions 84 of the elastic members 72 therebetween plates 82 and 86.

The pulley system 74 comprises a plurality of individually rotating pulleys 88 that have a common central axis which is attached to the support structure 52. The pulleys 88 have annular slots that are capable of allowing the elastic loops 72 which consisted of two elastic cords to rotate therearound.

Figure 8:
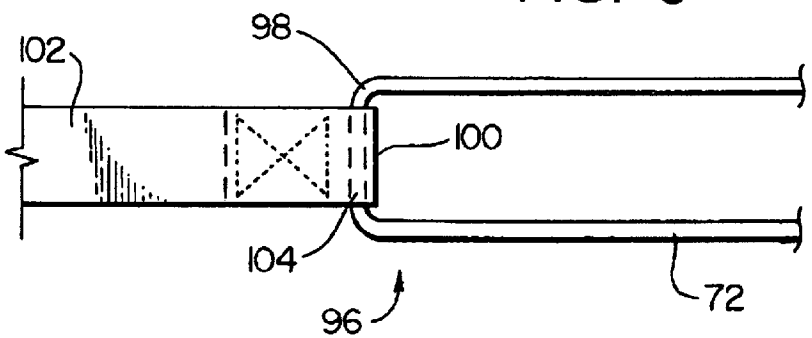
FIG. 8 is a top view of the loop portion of an elastic member taken at line 8-8 in FIG. 5

The support system 78 that is best seen in FIG. 4 comprises a latterly extending member 92 which has a number of vertically extending fingers 94. Each finger 94 is adapted to receive a corresponding elastic member 72 which is substantially aligned in the lateral direction. The head portion 96 of the elastic members 72 have a loop portion 98 that is best seen in FIG. 8. The loop portion 98 has an inner surface 100 that is adapted to engage a finger extension. When the elastic loop members 72 are not in an operative position, the corresponding loop portion 98 is mounted on the fingers 94 of the support system 78.

Figure 7:
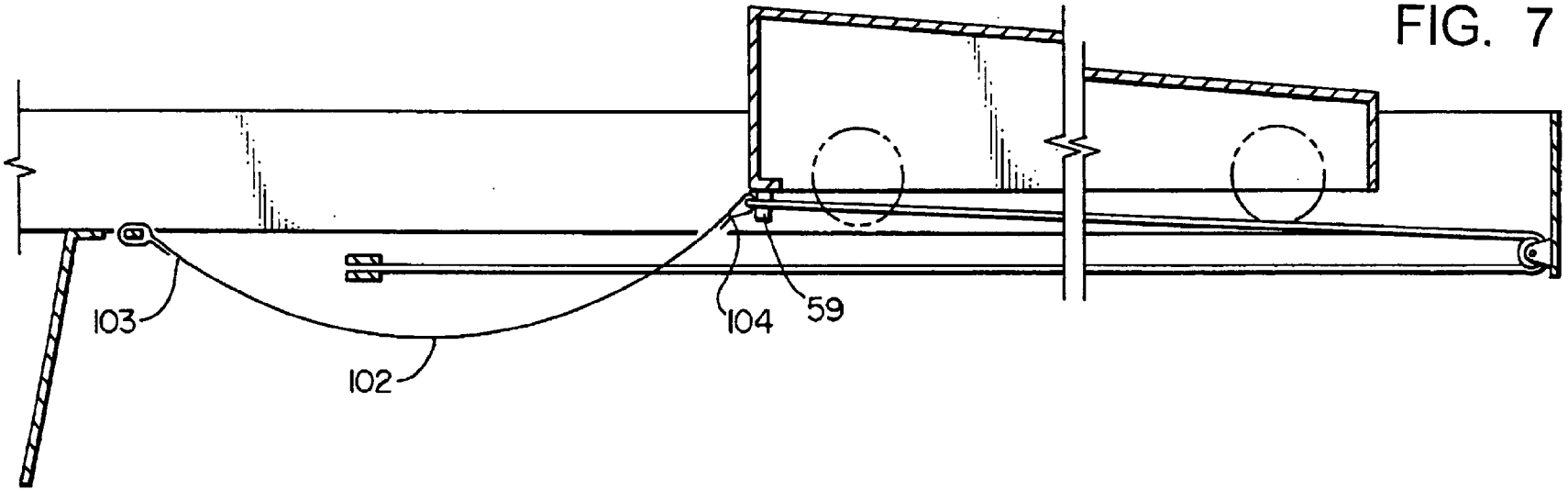
FIG. 7 is a vertical cross-sectional view of the frame and carriage showing an elastic member in an operative position and the corresponding strap hanging freely.

The elastic members 72 are connected to the head portions 1.02 which has a base portion 103 and an attachment section 104 which is preferably a loop that extends around the loop portion 98 (see FIG. 7). The strap 102 is mounted to a strap connection area 105 that comprises a laterally extending member 106. The strap 102 further has defined a first portion 108 and a second portion 110 that will further be discussed herein (see FIG. 6).

There will now be a detailed discussion of how the elastic members 72 are quickly and easily transformed from an inoperative position to an operative position. As seen in FIG. 3, the apparatus 50 has four of the elastic loop members 72 in a non-operative position where the loop portions 98 to our positioned on the fingers 94 of the support member 78 (see FIG. 4).

As seen in FIG. 3, the elastic members 72*b* and 72*e* are in the operative position while the remaining elastic members (72*a*, 72*c*,72*d*, and 72*f*) are in the non-operative position. For illustrative purposes we will discuss how the therapist or exercise participant will place the elastic loop member 72*c* into an operative position. As seen in FIG. 6, the therapist is exerting a substantially vertical force to the strap 102*c* at portion 108 and a substantially downward force at portion 110 of the strap 102*c*. This action causes the loop portion 98 to be repositioned to a headward and upward location and hence be mounted upon the downwardly extending fingers 59*c* of the carriage 52. Hereafter, when the exercise participant is using the apparatus 50 by exerting force on the kickplate and hence oscillating the carriage back and forth the longitudinal direction, the straps 102 in the operative position will simply hang loosely as seen in FIGS. 3 and 7 and fall downwardly as the carriage travels in the headward direction. Therefore, the straps 102 of the mounting strap system 80 are primarily for engaging the elastic members 72 to and from the inoperative to operative positions. It should be noted that as seen in FIGS. 6 and 8, the attachment portion 104 is somewhat loosely attached to the loop portion 98 and therefore cannot maintain a moment about the lateral axis at the loop portion 98. The significance of this will be further discussed herein and is very significant in the second embodiment.

Figure 9:
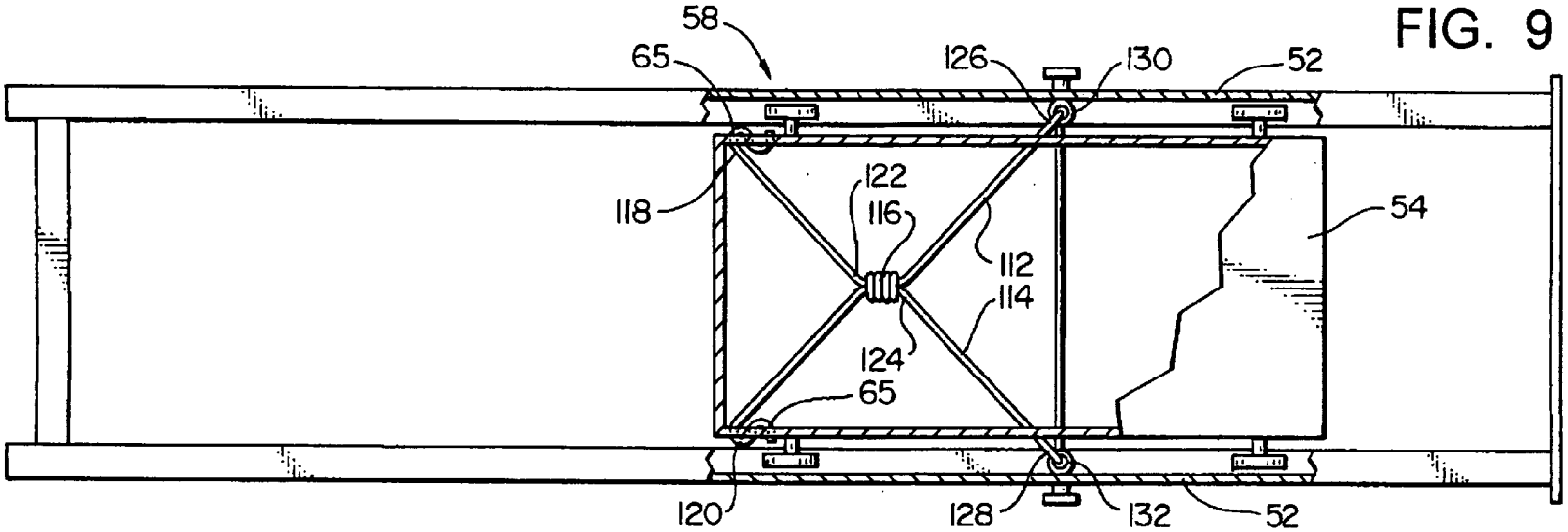
FIG. 9 is a horizontal partial sectional view where a portion of the carriage 54 is removed exposing the rebound system.

As seen in FIG. 9, the rebound system 58 consists of a first flexible member section 112, a second flexible member section 114 and elastic member or resistance member 116. The first and second rope sections 112 and 114 are preferably nylon rope and each have first end portions 118 and 120, central portions 122 and 124, and finally second end portions 126 and 128. As seen in FIG. 9, the first end portions 118 and 120 are attached to the carriage 52 and extend through a plurality of holes 65 located in the lower portion of the carriage 52. The holes area method of frictionally locking the first end portions 118 and 120 to the carriage. Of course, the first end portions 118 and 120 can be attached to the carriage in a number of ways; however, the holes 65 to provide a method of adjusting the length of the rope sections 112 and 114.

The second end portions 126 and 128 are mounted to the frame 54. As seen in FIG. 9, the preferred method of mounting the second end portions 122 and 124 is to extend these portions through eye loops 130 and 132 and connect these end portions 126 and 128 together. In a preferred form, one piece of rope is used for the rebound system 58 where the first end portion 118 is mounted to the carriage and it extends through the elastic member 116, then extends through eye loop 130, then through the second eye loop 132, then back through the elastic member 116 and finally terminating back to the carriage at the first end portion 120. The elastic member 116 can be a rubber doughnut, but the purpose of the elastic member 116 is to resist the lateral separation between central portions 122 and 124; Of course, other mechanisms could be employed such as a small spring which is attached to the central portions 122 and 124. As the carriage travels to the extreme longitudinal positions, the force that is acted upon the carriage from the rebound system 56 increases exponentially to a theoretical infinite value. Of course, the maximum tension would be the maximum tensile strength of the nylon rope which comprises the sections 112 and 114.

Figure 10:
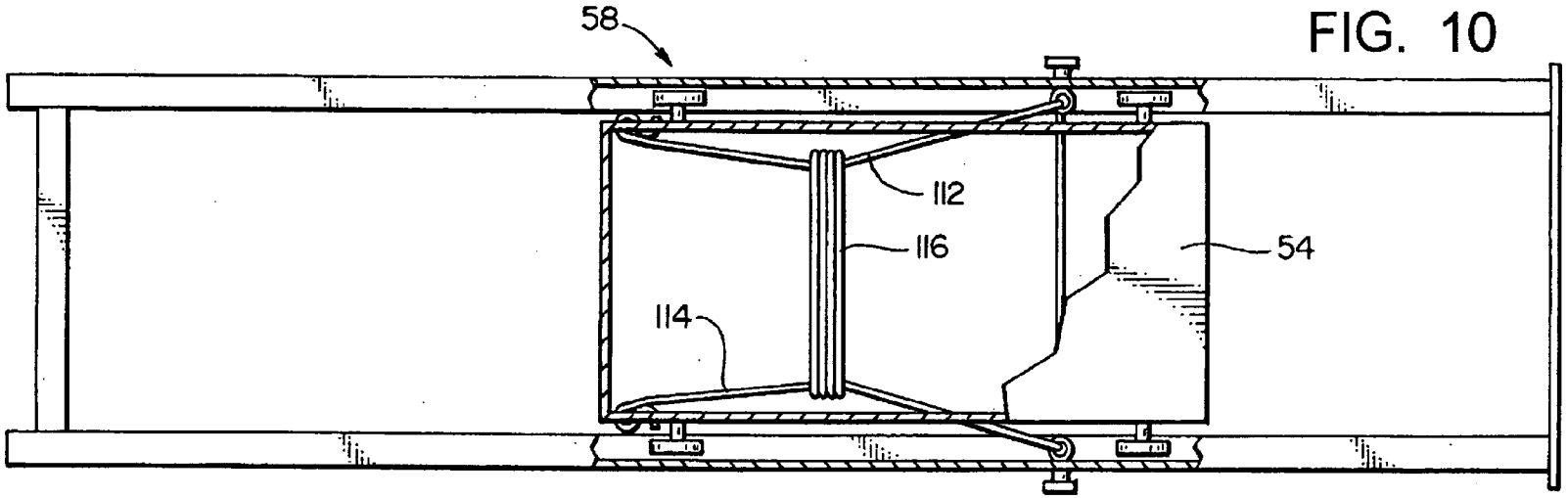
FIG. 10 is a horizontal partial sectional view showing the rebound system in operation where the elastic member is resisting lateral separation of the two flexible members.
Figure 11:
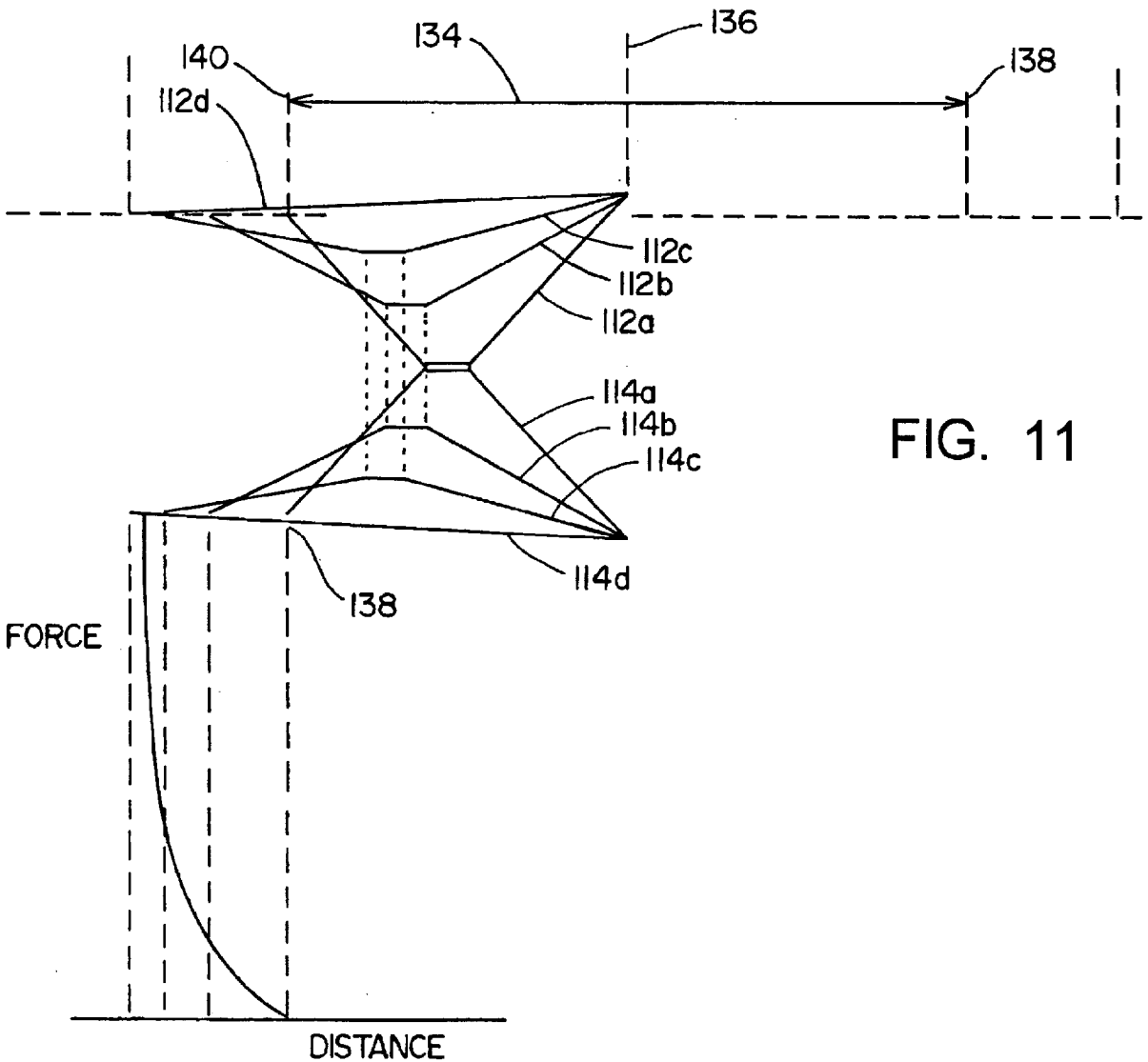
FIG. 11 is a schematic view of the progression of the flexible members showing the exponentially increasing force upon a carriage with respects to distance.

As seen in FIG. 9, the effective range of the carriage 52 is shown as 134 where the central portion 136 corresponds to the longitudinal position in of the eye loops 130 and 132. The effective range includes a lower first tension position 138 and an upper first tension position 140. The positions 138 and 140 are defined as the location of the carriage 52 where the central portions 122 and 124 just begin to put tension in the elastic member 116. As seen in FIG. 10, the first and second rope sections 112*a* and 114*a* first begin to be in tension at location 140. As the carriage continues to move headwardly to the position shown as 112*b* and 114*b*, the tension increases slightly to deaccelerate the carriage 52. If the carriage is moving sufficiently fast so it that extends the flexible members to a position shown as 112*c* and 114*c*, then there is a significant increase in tension in the rope members 112 and 114 due to the fact that the rope sections have less of a force component in the lateral direction. If the carriage was traveling extremely fast and the exercising participant is perhaps excessively gravitationally challenged then the rope sections 112 and 114 would approach a position shown as 112*d* and 114*d*. Of course due to lack of a lateral force component the rope members 112 and 114 could never become directly aligned in the connection points and hence the tension in the rope sections 112 and 114 would exponentially increase to infinity as shown in FIG. 11. Of course the same analysis applies when the carriage is traveling in the opposite longitudinal direction at location 138.

Figure 12:
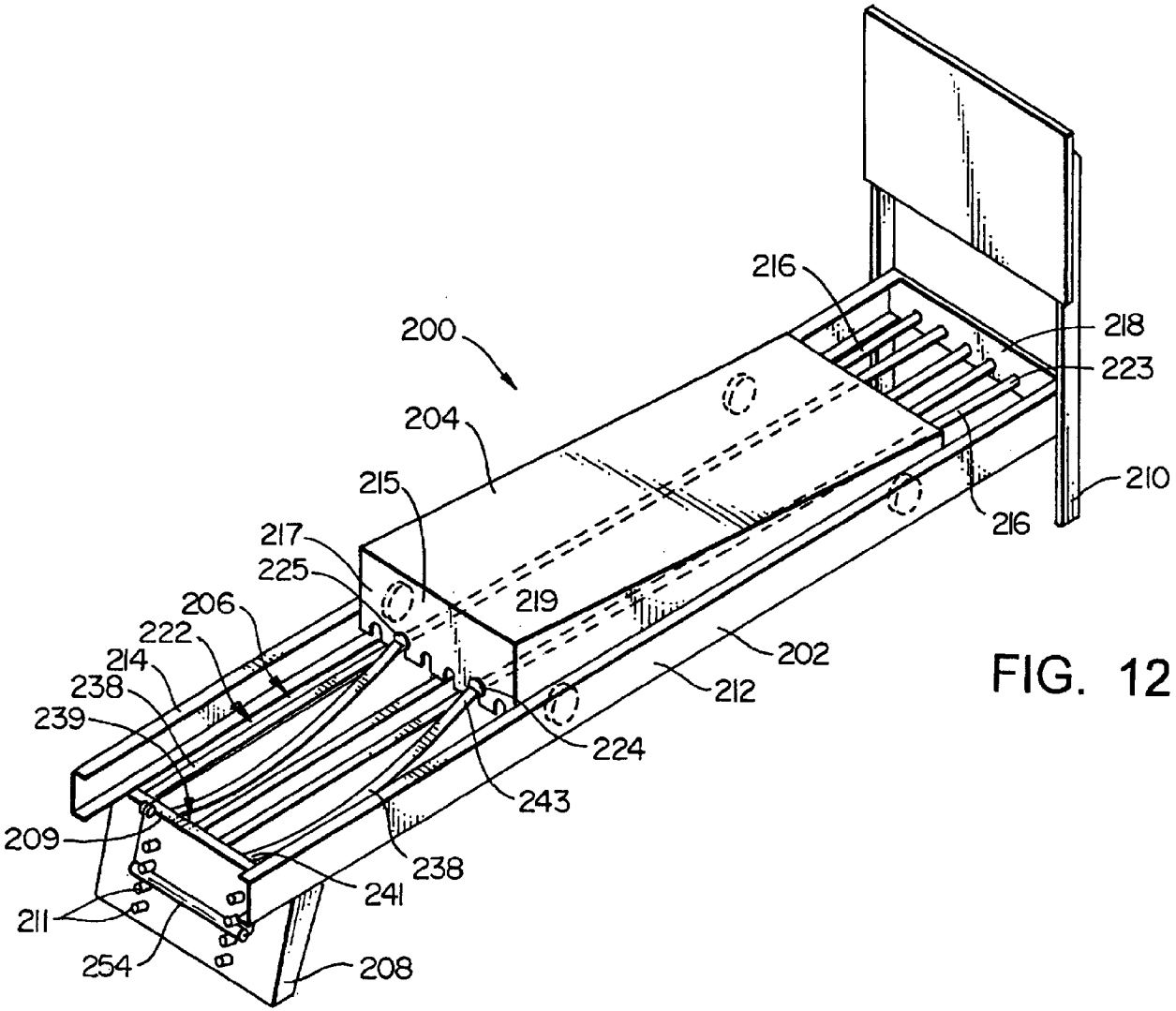
FIG. 12 is a second embodiment of the apparatus of the present invention.
Figure 13:
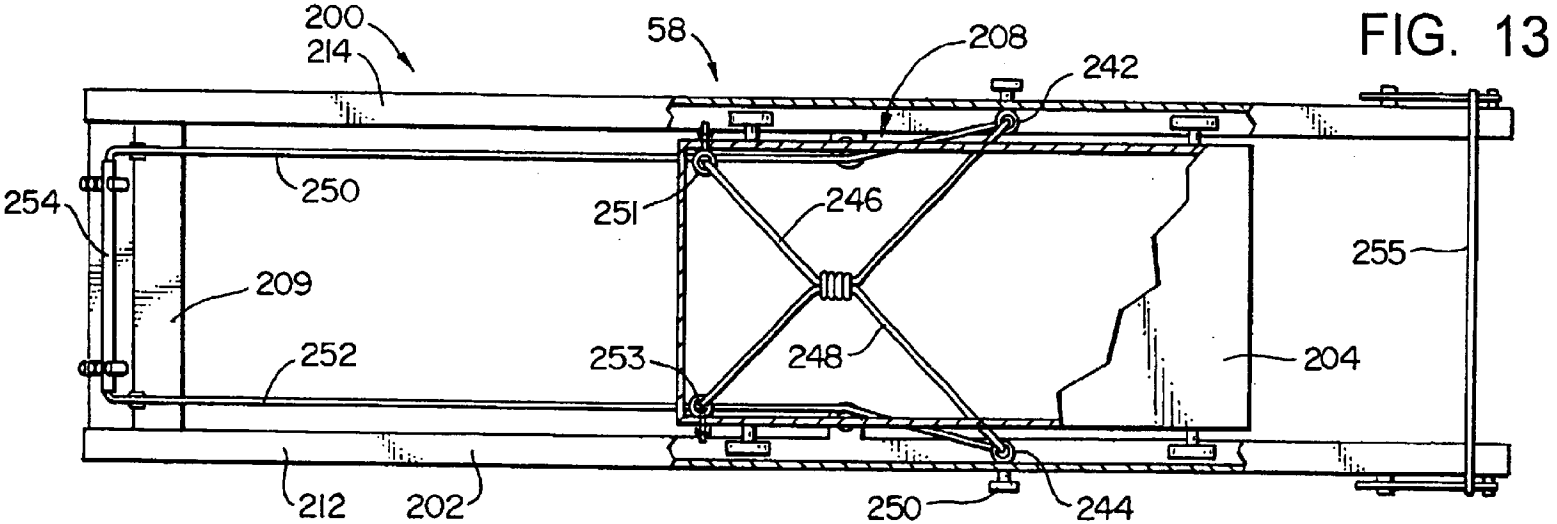
FIG. 13 is a horizontal partial sectional view of the rebound system of the second embodiment.
Figure 14:
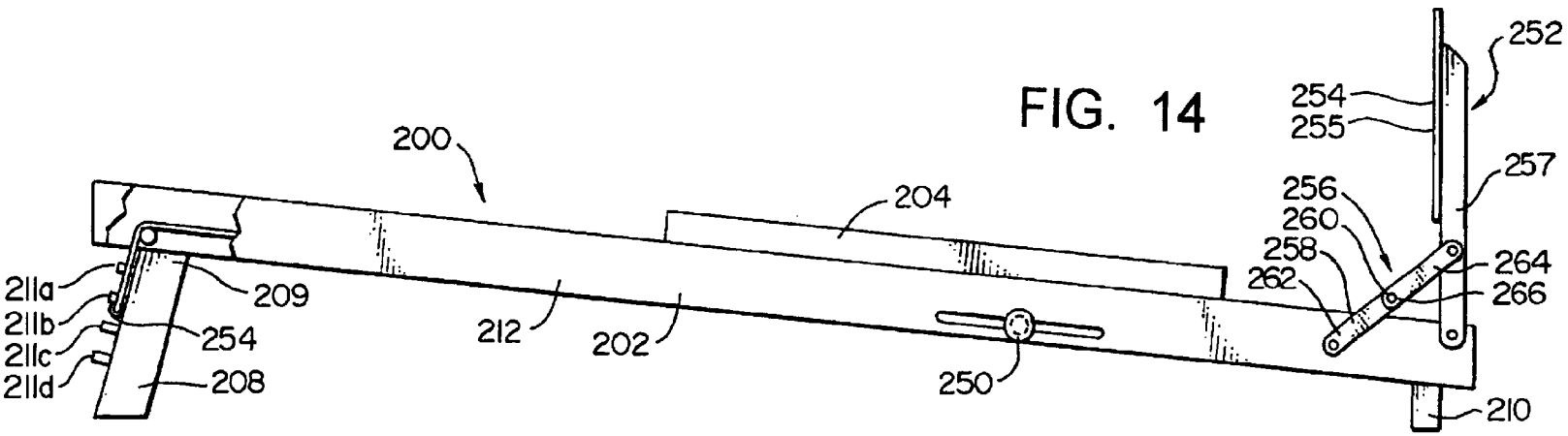
FIG. 14 is an elevational view of the exercise device.

A second embodiment of the present invention is shown in FIG. 12. This embodiment is substantially similar to the first embodiment with slight modifications. The apparatus 200 comprises a support structure or frame 202, a carriage 204, a resistance system 206, and a rebound or range of motion control system 208. As seen in FIGS. 12–14, the frame 202 comprises a first support 208 and a second support 210 that are located at the head end and foot end longitudinal locations. The first support 208 has an upper portion 209. On the headward face of the first support 208 there are located a plurality of support pegs 211 that will be further discussed herein. The frame further comprises two longitudinally extending members 212 and 214 that are angled upwardly when traveling from the foot end to head end in the longitudinal direction.

The carriage 204 is substantially similar to the carriage 54 of the first embodiment with the exception the engagement section 215 as seen in FIG. 12 comprises a plate 217 that forms a plurality of slots 219 that are adapted to receive corresponding head portions or handle portions 224 of the rubber tube members 216.

The resistance system 206 comprises a plurality of rubber tubing or elastic members 216, a mounting portion 218, and a mounting strap system 222. The rubber tubing members 216 are connected to the mounting portion 218 that is located in the foot end portion of the frame 202. As seen in FIG. 13, the carriage 204 is removed and the resistance system 206 is exposed.

Figure 15:
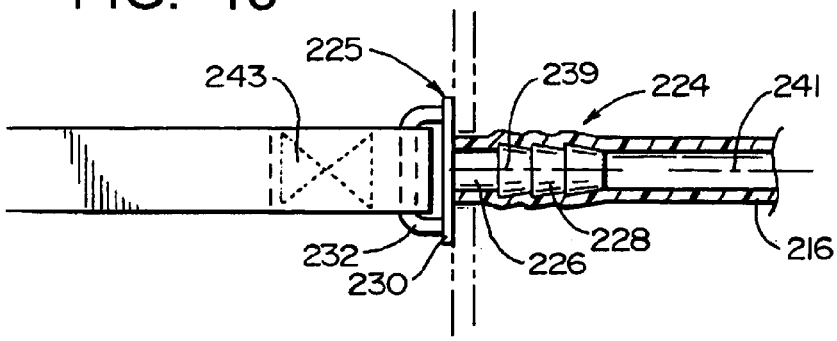
FIG. 15 is a top view of the barbed connecting members positioned in the support system where a top portion of the elastic member is removed.

The rubber tubing members 216 have a base portion 223 and a head portion 224. As best seen in FIG. 15, the connecting members 225 are located in the head portion 224 and comprise a shaft 226, a barbed extension member 228, a head member 230 and a strap connection portion 232.

As seen in FIG. 12, the mounting strap system 222 comprises a plurality of longitudinally extending straps 238 and a connection portion 239. Each strap 238 has a base portion 241 and a connection portion 243. The connection portions 243 are attached to orresponding strap connection portions 232 of the connecting members 225. The headward portion of the straps 238 are connected to the connection portion 239. The connection portion is similar to that of the first embodiment and hence does not require further explanation.

The rubber tubing members 216 pass under the carriage 204 and the head portions hang from the attached straps 238 when they are in the non-operative state. As seen in FIG. 15, the barbed extension 228 extends therein the tubing member 206. When tension is applied to the straps 238 the force is transmitted through the shaft portion 226 down to the barbed portion 228. By using the straps 238 the central axis 239 of the barbed portion 228 is always aligned with the central axis 241 of the elastic member or rubber tubing 216 and hence the most inward portion 240 of the barbed portion 228 will never gouged into the interior surface of the tubing 216.

The operation of the resistance system is very similar to the first embodiment as seen in FIG. 6. However, instead of positioning the loop portion 100 onto the fingers 59 of the carriage 52, now the therapist or exercising participant repositions the head portion 224 of the elastic straps into the corresponding slots 219 of the carriage 204. The slots 219 correspond to the rubber tubing members.

Figure 16:
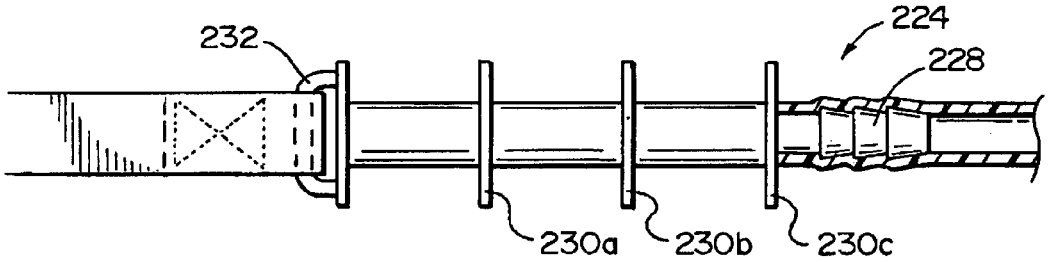
FIG. 16 is a second embodiment of the connecting member.

FIG. 16 shows another embodiment of the head member 224 where a plurality of support disks 230 are employed. Each support disk 230 is adapted to engage the slots 219 of the carriage 204. If the therapists or exercising participant desires to have a higher initial load upon the carriage then he or she can engage support disks 230*b* or 230*c* onto the slots 219 of the carriage 204.

As seen in FIG. 13, there is a second embodiment of the rebound or range of motion control system 208. The primary advantage of the second embodiment is that the range of motion 134 as seen in FIG. 11 of the carriage 204 can be more easily adjusted.

As seen in FIG. 13, the rebound system 208 consists of eye loops 242 and 244, a first flexible member or first rope portion 246 and a second flexible member or second rope portion 248. These elements are similar to those of the first embodiment. However, in the second embodiment, instead of having the rope connect directly between the eye loops 242 and 244, the rope sections 250 and 252 extending headwardly to the upper portion of the rear support leg 208 and then substantially downwardly to the set of support pegs 211. The rope sections 250 and 252 extend through the end adjustment member or rigid pipe section 254 and are connected therein. The preferred method of building the rebound system 208 is to have the rope sections 246,248, 250, and 252 all be portions of one continuous strand of rope which is terminated in the carriage in the eye loops 251 and 253 or otherwise attached thereto.

To adjust the rebound system 208 the therapist or exercise participant would simply reposition the rigid pipe section 254 in a footward direction and reposition it immediately below the desired pegs set 211. For example, as seen in FIG. 13, if it is desired to decrease the range of motion of the carriage, the physical therapist or exercising participant would reposition the rigid pipe section 254 from immediately below the pegs sets 211*b* to the position as indicated in the broken line that is immediately below pegs set 211*c*. This repositioning of the rigid pipe section 254 has the effect of repositioning the rope sections 250 and 252 in the head end direction which in turn will reduce the length of the sections 246 and 248. Of course, other embodiments of decreasing the length of the flexible members 246 and 248 could be employed without departing from the scope the invention.

As seen in FIG. 14, the second embodiment has an additional adjustment feature which adjusts the central portion 136 that is illustrated in FIG. 11. As seen in FIGS. 13 and 14, the adjustable member 250 has a tapped portion that is adapted to receive the threaded portions of the eye loops 242 and 244. The therapist or exercising participant would loosen the adjustable member 250 so it is not as frictionally engaged to the frame 202. Then she will reposition the eye loops 244 in the substantially longitudinal direction. Of course, an assortment of locking mechanisms could be employed to reposition the eye loops 242 and 244. With this adjustment feature the center of travel 136 and range of travel 134 can be adjusted to accommodate a wide variety of exercising participants with different body types and different ranges of motions in their hip and knee joints.

A foldable kickplate is a further feature of the second embodiment. As seen in FIG. 14 the kickplate assembling 252 comprises a kickplate member 254 and a folding-locking assembling 256. The kickplate member 254 has an impact section 255 and a frame portion 257.

The folding-locking assembly 256 comprises a locking arm 258 and a pivot section 260. The locking arm 258 has a first section 262 and a second section 264. The first section 262 is pivotally mounted to the frame 202 and further pivotally mounted to the second section 264 at pivot point 266. The second section 264 is then the pivotally mounted to the frame portion 257 of the kickplate 254. When it is desired to ship for store the apparatus 200 the kickplate assembly 254 can fold down in a headward and downward arc. When the apparatus 200 is then desired to be used the kickplate assembling to 54 can then be rotated in a clockwise direction to the position shown in FIG. 14.

Figure 17:
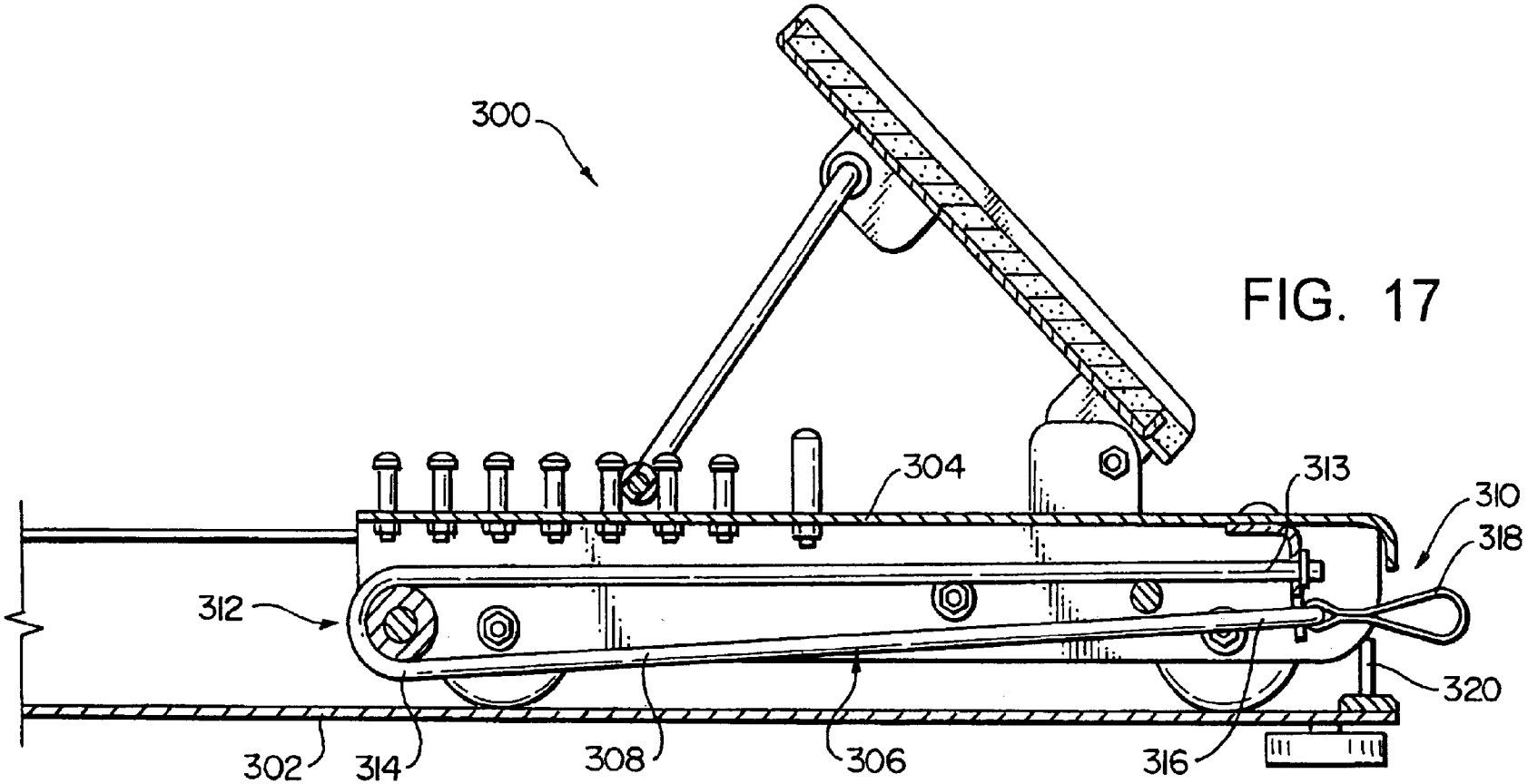
FIG. 17 is a horizontal cross-sectional view of a third embodiment.
Figure 18:
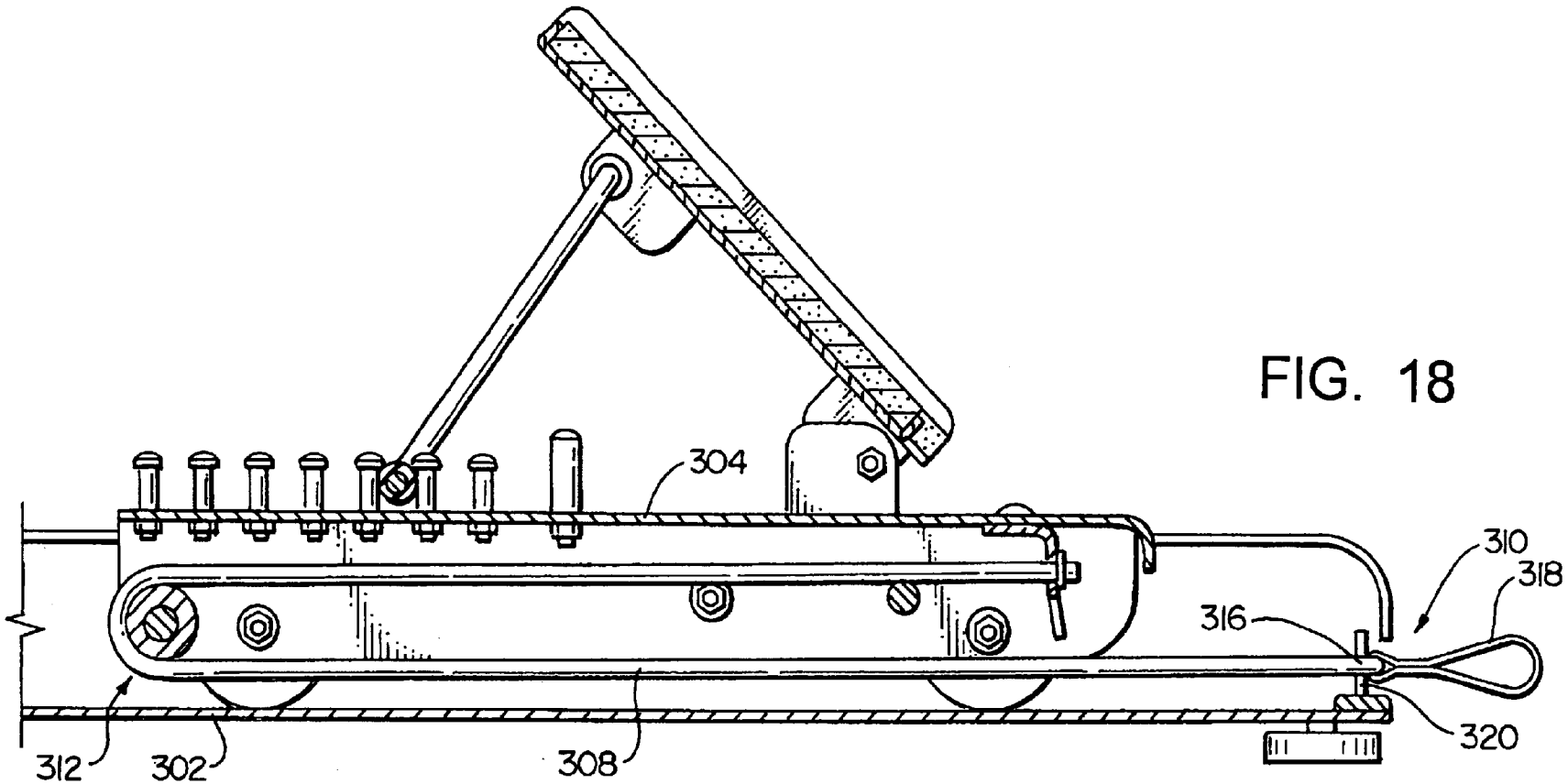
FIG. 18 is a horizontal cross-sectional view of the third embodiment where an elastic member is positioned on a finger to supply resistance to the carriage.

FIG. 17 shows a third embodiment where there is the apparatus 300 that comprises a frame 302, a carriage 304, and a resistance system 306.

The resistance system 306 comprises a plurality of elastic members 308, an engagement system 310 and a pulley system 312. The elastic members 308 are similar to the elastic members in the first embodiment and can be made from bungee cord material. The resistance system 306 travels with the carriage unlike the resistance system 56 of the first embodiment. The elastic members 308 have a first location 313, a base portion 314 and a head portion 316. Located at the head portion 316 is a tab member 318. To place a elastic member 308 to an operative position the therapist or exercising participant grabs the tab member 318 and pulls it to the lower position onto the fingers 320 that are mounted to the frame 302.

Figure 19:
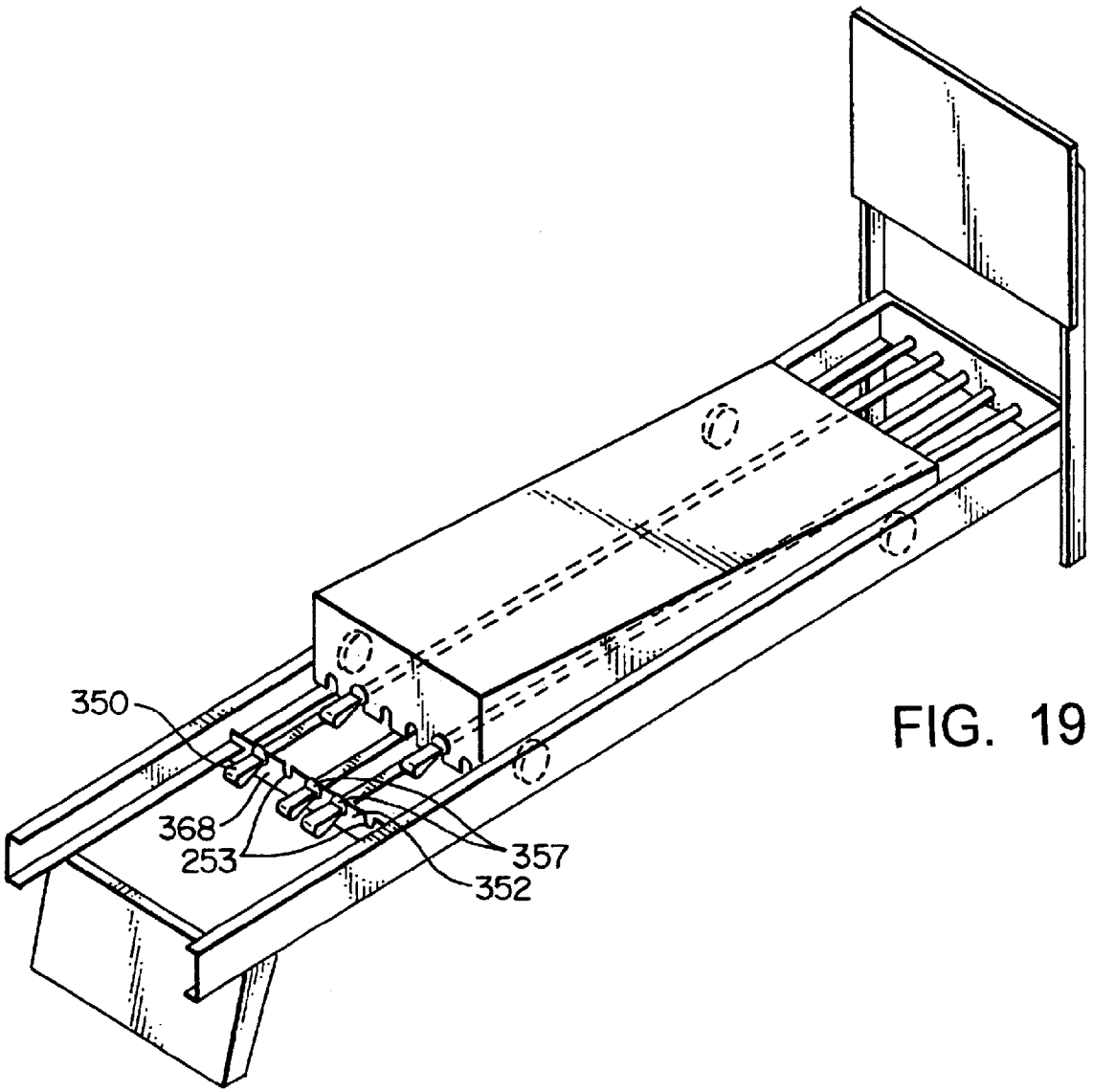
FIG. 19 is a fourth embodiment where straps are attached to the connecting devices attached to the elastic members.

FIG. 19 shows a fourth embodiment that is similar to the second embodiment. The main difference in this embodiment is that the mounting strap system 222 is replaced with tab members 350. As seen in FIG. 19 the connecting member 368 is positioned on the support system 352 that is fixed to the frame has a plurality of slots 253 that are adapted to engage the support disks 357.

Figure 20:
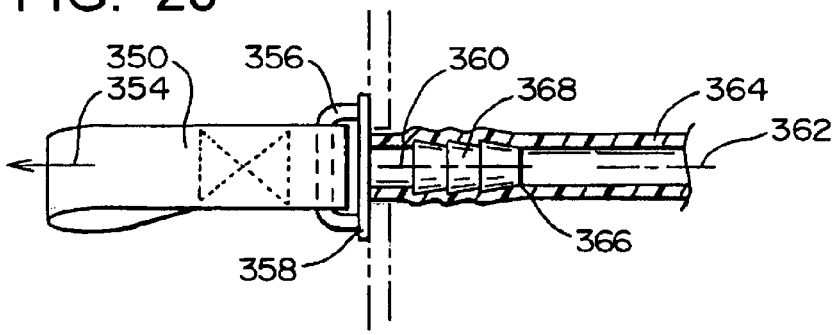
FIG. 20 is a top view of a connecting member similar to FIG. 15; however the connecting portions are connected to a tab instead of a strap.
Figure 21:
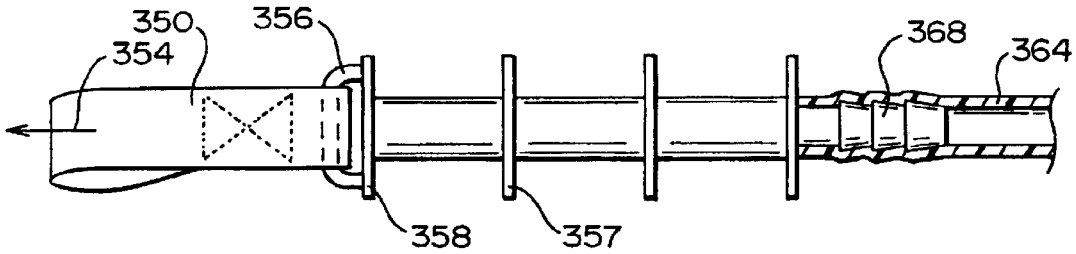
FIG. 21 is a top view of a connecting member similar to the connecting member shown in FIG. 16 except it is attached to a tab.

As seen in FIGS. 20 and 21 when a force is exerted upon the tab members 350 as indicated at 354, the tab connection portions 356 (similar to strap connection portions 232) can not handle a moment about an axis perpendicular the central axis 360 of head portion 358. Therefor the central axis 360 will always remain parallel to the central axis 362 of the flexible tubing 364 and hence the ridge 366 of the connecting member 368 will not gouge into the interior surface of the tubing member 364.

While the invention is susceptible of various modifications and alternative forms, specific embodiments thereof have been shown by way of example in the drawings and will herein be described in detail. It should be understood, however, that it is not intended to limit the invention to the particular forms disclosed, but, on the contrary, the intention is to cover all modifications, equivalents and alternatives falling within the spirit and scope of the invention as expressed in the appended claims.

I claim:

1. An exercise apparatus comprising:

a) a frame having a longitudinal axis, a forward front end portion, and a rear head end portion;

b) a carriage having a foot end carriage portion and a head end carriage portion, said carriage being mounted to said frame to travel on a back-and-forth travel path along the frame between a rear location and a forward location;

c) a plurality of elongate resistance members, each of which comprises:

i. an elongate strap section having a first strap connecting end connected to a head connecting portion of the frame and a second strap connecting end;

ii. an elongate elastic section having a first end portion connected to the second strap connecting end at an intermediate location of the resistance member, and a second end portion having an operative connection to a foot portion of the frame;

d) each of said elongate resistance members having a releasable strap connector which is arranged to be releasably connected in an operating position to an engagement section of the carriage, said releasable strap connector being located at an intermediate connector location along the resistance member, each of said resistance members being arrange so that the operating position the resistance member yieldingly resists movement of the carriage for the head end portion of the frame;

e) each strap section having sufficient length and being arranged so that said strap section permits movement of the carriage on the back-and-forth travel path as its related elastic section extends and contracts in yieldingly urging the carriage toward the foot end portion of the frame.

2. The apparatus as recited in claim 1, wherein each of said strap sections is substantially non-elastic.

3. The apparatus as recited in claim 2, wherein the connector of each resistance member is at a location which is proximate to said intermediate connecting location of the resistance member.

4. The apparatus as recited in claim 1, wherein the connector of each resistance member is at a location which is proximate to said intermediate connecting location of the resistance member.

5. The apparatus as recited in claim 1, wherein the strap connector of each resistance member also functions to connect this strap section to the elastic section.

6. The apparatus as recited in claim 5, wherein the elastic section of each resistance member is formed in a loop where there are two elongate loop portions and a loop end of the elastic section connects to the strap connector.

7. The apparatus as recited in claim 5, wherein the frame has a releasable strap frame connecting portion at which a portion of each strap proximate to the intermediate connecting location can be releasably connected to the frame.

8. The apparatus as recited in claim 1, wherein the strap connector of each resistance member also functions to connect this strap section to the elastic section.

9. The apparatus as recited in claim 8, wherein each strap section is arranged so that each strap can be manually manipulated to connect and disconnect its related resistance member to and from the releasable strap frame connecting portion, and also can be manually manipulated to connect and disconnect its related resistance member to and from the engagement section of the carriage.

10. The apparatus as recited in claim 1, wherein each elastic section engages a related pulley at the head end portion of the frame and extends therefrom to connect at a connecting location on the frame which is forward of the related pulley.

* * * * *